United States Patent [19]

Inoue

[11] Patent Number: 4,541,349

[45] Date of Patent: Sep. 17, 1985

[54] SEWING METHOD AND MACHINE

[75] Inventor: Kiyoshi Inoue, Tokyo, Japan

[73] Assignee: Inoue-Japax Research Incorporated, Kanagawaken, Japan

[21] Appl. No.: 453,175

[22] Filed: Dec. 27, 1982

[30] Foreign Application Priority Data

Dec. 24, 1981 [JP] Japan ..... 56-195862[U]

[51] Int. Cl.[4] ..... D05B 55/14

[52] U.S. Cl. ..... 112/221; 112/262.1; 156/73.2

[58] Field of Search ..... 112/221, 220, 262.1, 112/158 E, 89, 2, 1; 156/73.1, 73.2

[56] References Cited

U.S. PATENT DOCUMENTS

| | | | |
|---|---|---|---|
| 3,296,990 | 1/1967 | Simijian et al. | 112/262.1 |
| 3,666,599 | 5/1972 | Obeda | 156/73.2 X |
| 3,724,566 | 4/1973 | Staros | 175/108 |
| 4,077,340 | 3/1978 | Braun et al. | 112/89 X |

FOREIGN PATENT DOCUMENTS

| | | | |
|---|---|---|---|
| 1083745 | 1/1955 | France . | |
| 615965 | 2/1980 | Switzerland . | |
| 987801 | 3/1965 | United Kingdom . | |
| 1094115 | 12/1967 | United Kingdom . | |
| 1115170 | 5/1968 | United Kingdom . | |
| 1429822 | 3/1976 | United Kingdom | 112/221 |
| 2544165 | 4/1977 | United Kingdom . | |
| 2059464 | 4/1981 | United Kingdom . | |

*Primary Examiner*—Peter Nerbun

*Attorney, Agent, or Firm*—Karl F. Ross; Herbert Dubno

[57] ABSTRACT

A sewing machine and method wherein a needle carrying a thread is axially reciprocated into and through a sewable material moving relative to the axis of the needle to stitch the material, and high-frequency mechanical oscillations are imparted to the reciprocating needle in the direction of its axis to facilitate the stitching of the material which may be thick and/or hard.

10 Claims, 7 Drawing Figures

FIG. 3A
FIG. 3B
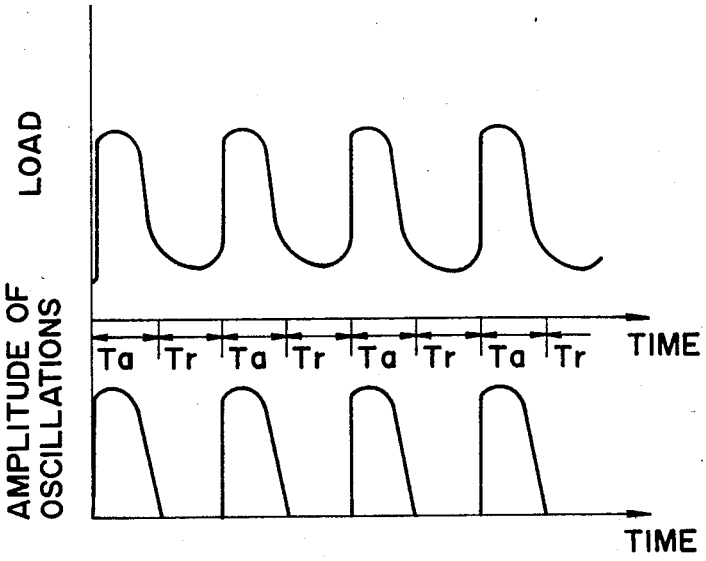
FIG. 4
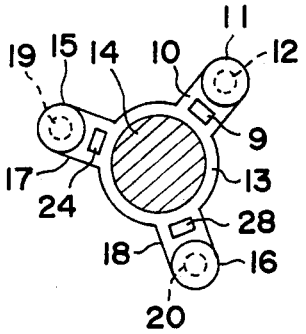
FIG. 5
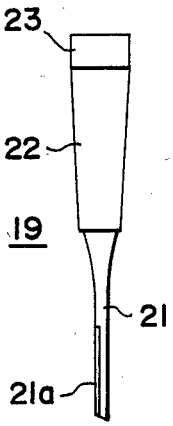
FIG. 6
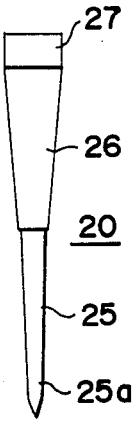

SEWING METHOD AND MACHINE

FIELD OF THE INVENTION

The present invention relates to the sewing art and, more particularly, to improvements in a sewing method and apparatus wherein a needle carrying a thread is axially reciprocated into and through a sewable material, e.g. cloth, leather or paper, which is moving relative to the axis of needle, to stitch the material.

OBJECTS OF THE INVENTION

It is an object of the present invention to provide an improved sewing method of the type described, which method enables practically any sewable material, even thick and/or hard, to be stitched with greater smoothness and ease and at a greater rate than heretofore.

Another important object of the present invention is to provide a relatively simple and compact sewing machine for carrying out the improved method described.

A further important object of the present invention is to provide a sewing machine as described which has one or more additional functions of cutting, welding and marking sewable or sewed materials.

SUMMARY OF THE INVENTION

In accordance with the present invention there is provided, in a first aspect thereof, a sewing method wherein a needle carrying a thread is axially reciprocated into and through a sewable material moving relative to the axis of the needle to stitch the material, which method comprises imparting high-frequency mechanical oscillations to the reciprocating needle substantially in a direction of the reciprocation.

Preferably, the mechanical oscillations imparted to said reciprocating needle are produced or intensified selectively during the advance stroke of each cycle of the needle reciprocation. To this end, a load of the needle experienced from the material during each cycle of the needle reciprocation is sensed and, when a predetermined change in the load is sensed, the amplitude of the mechanical oscillations is increased from nil or a predetermined minimum level.

The invention also provides, in a second aspect thereof, a sewing machine wherein a needle carrying a thread is axially reciprocated into and through a sewable material moving relative to the axis of the needle to stitch the material, which machine includes means for imparting high-frequency mechanical oscillations to the reciprocating needle substantially in a direction of the reciprocation. Preferably, the machine further comprises means associated with the said means for producing or intensifying the mechanical oscillations imparted to the reciprocating needle selectively during at least a time period in which the needle is advanced into and through the material in each cycle of the needle reciprocation. The oscillation means may comprise an electromechanical transducer connectable in an oscillation transmitting relationship with said needle and a power supply for energizing the electromechanical transducer to impart said mechanical vibrations to said reciprocating needle. The machine may further comprise sensing means responsive to a load experienced by the needle from the material during each cycle of the needle reciprocation and control means responsive to an increase in the load for controlling the power supply to produce or intensify the mechanical oscillations imparted to the needle selectively during at least a time period in which the needle is advanced into and through the material in each cycle of the needle reciprocation.

BRIEF DESCRIPTION OF THE DRAWING

These and other features of the present invention as well as advantages thereof will become more readily apparent from a reading of the following description of certain embodiments thereof when made with reference to the accompanying drawing in which:

FIGS. 3(A) and 3(B) are graphical representations illustrating (a) changes in the sewing load which are experienced in sewing machines and (b) a controlled amplitude of mechanical oscillations according to a preferred form of the method according to the present invention;

FIG. 4 is a cross sectional view diagrammatically illustrating a portion of the structure shown in FIG. 1 and a portion of the machine not shown in FIG. 1;

FIGS. 5 and 6 are side-elevational views diagrammatically illustrating cutting and welding/marking tools, respectively, which may be additionally mounted on the machine according to the present invention.

SPECIFIC DESCRIPTION

Figure 1:
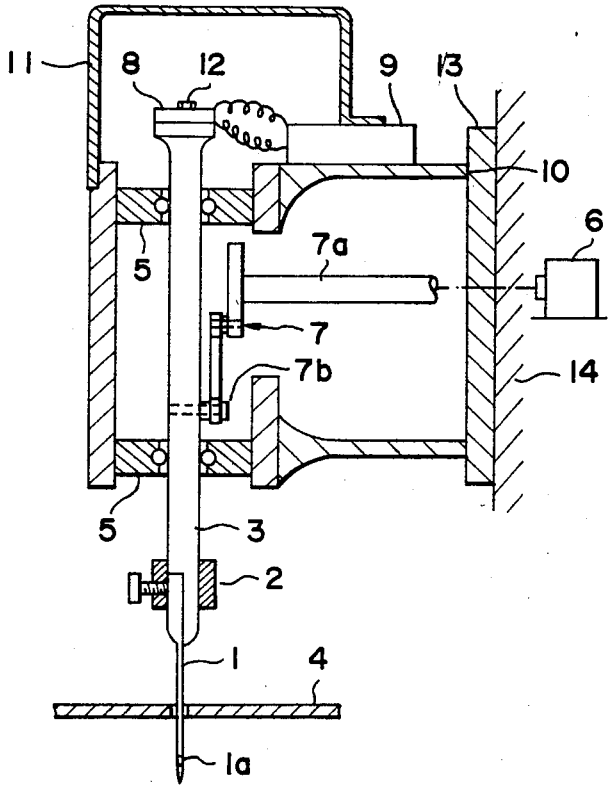
FIG. 1 is an elevational view partly in section diagrammatically illustrating essential portions of a sewing machine incorporating a mechanical vibrator according to the present invention.

Referring now to FIG. 1, a sewing machine according to the present invention may have a conventional basic structure and makes use of a needle 1 which is formed at a free end portion thereof with an aperture 1*a* having a thread (not shown) passed therethrough. The needle 1 is securely held by means of a chuck 2 to an end (lower) portion of a rod 3. The needle 1 is here supported coaxially with the rod 3 and may extend vertically, perpendicularly to a material 4, e.g. cloth, leather or paper, to be stitched. The rod 3 is supported by a pair of bearing assemblies 5 so as to be vertically movable up and down or capable of vertical reciprocation, and is held thereby against lateral movement and rotation. The rod 3 is vertically or axially reciprocated by a motor 6 via a crank 7 including a crankshaft 7*a* to which the output shaft of the motor 6 is drivingly coupled via a gear transmission (not shown) and a crank pin 7*b* secured to the rod 3. The needle 1 is thus axially reciprocated into and through the material 4 being moved manually or otherwise relative to the axis of the needle 1 to stitch the material 4.

Shown secured to the upper end of the rod 3 is an electromechanical transducer 8 which is energized by a power supply unit 9 to impact high-frequency mechanical oscillations to the reciprocating needle 1 in its axial or longitudinal direction. The transducer 8 and the power supply unit 9 themselves are conventional in design and are commercially available. The power supply unit 9 is here mounted on a casing 10 secured to a frame 11 of the machine which has also the bearing assemblies 5 secured thereto. The transducer 8 is secured to the rod 3 by means of a bolt 12. The rod 3 is configured to serve as a horn for propagating and amplifying sonic or ultrasonic oscillatory signals produced in the transducer 8 to the needle 1. The motor 6 is accommodated on a suitable support within the casing 10.

It has been found that when high-frequency mechanical oscillations are imparted axially to the reciprocating needle 1, the needle 4 can penetrate into and through the material 4 with greater ease and smoothness in each cycle or reciprocation or each advancing stroke. Thus, stitching of any thick and/or hard sewable material 4 is facilitated.

The reciprocating needle 1, according to the present invention, is axially oscillated with an amplitude of the oscillations, for example, of 20 μm. This results in an oscillatory advancement of the needle 1 in each cycle of reciprocation in which an oscillation occurs each time the needle advances by a distance of 29 to 30 μm. During the advance stroke in each cycle of reciprocation, a plurality of oscillations should be experienced by the needle 1.

In this manner, the penetration of the needle 1 into and through the material 4 is greatly facilitated because of a significant reduction in the resistive friction of the material 4 against the penetrating needle 1. The rate of stitching can thus be increased and the possibility of accidental breakage of the needle 1 is also reduced.

In accordance with a further feature of the present invention, the mechanical oscillations imparted to the reciprocating needle 1 are imparted selectively during the advance stroke of each cycle of needle reciprocation. Alternatively, the mechanical oscillations may be damped selectively during the retraction stroke of each cycle of needle reciprocation.

Figure 2:
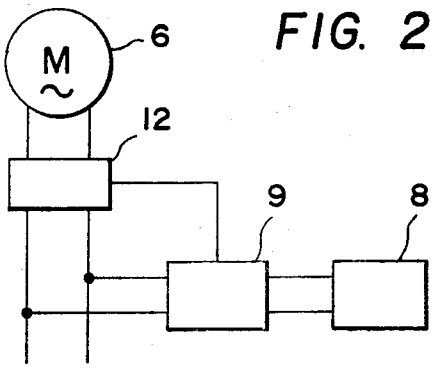
FIG. 2 is a circuit diagram in a block form illustrating a preferred mode of a sewing method embodying the present invention.

In FIG. 2 there is shown a circuit arrangement which enables such a modified mode of imparting mechanical oscillations to the reciprocating needle 1 to be executed. A sensor 12 is associated with the motor 6 to measure changes in the load of the crank 7 connected to the output of the motor 6. FIG. 3 shows in graph (A) how the load changes over the advance strokes (Ta) and retraction strokes (Tr) in the reciprocation of the needle through the material 4. The sensor 12 responsive to the changes in the load provides switching or control signals which act on the power supply 9 to actuate or increase the vibrational amplitude of the transducer 8 selectively during the advance stroke of each cycle of needle reciprocation. FIG. 3(B) shows a resulting controlled mode of mechanical oscillations in which the reciprocating needle 1 is mechanically oscillated selectively during the advance stroke. Such a controlled mode is advantageous in that it achieves results substantially same as where the reciprocating needle 1 is oscillated over the entire cycles of reciprocation and at the same time significantly reduces noises produced by the needle oscillations. In FIG, 3(B) it is shown that the amplitude of mechanical vibrations is maximized when the needle 1 experiences the highest magnitude of load.

Alternative manners of sensing the changes in the load include provision of a strain gauge on an element in the crank 7 such as on the crankshaft 7*a* to measure strains thereof.

According to still a further feature of the present invention, a sewing machine as described may have one or more additional functions of cutting, welding and marking sewable materials 4. To this end, referring back to FIG. 1 and also to FIG. 4, the casing 10 is securely carried by a collar 13 which is rotatably fitted onto a column 14. As shown in FIG. 4, the column 14 is designed to carry further frames 15 and 16 by means of arms 17 and 18, respectively, which are both secured to the collar 13. The frames 15 and 16 are provided to carry sonic or untrasonic cutting and welding/marking tools 19 and 20 as shown in FIGS. 5 and 6, respectively.

The cutting tool 19 shown in FIG. 5 comprises a cutter 21 having a cutting edge 21*a* and secured by means of a bolt to holder 22 in the form of a horn at one end thereof which is of smaller cross section.

The other (upper) end of the horn holder 22 has an electrochemical transducer 23 secured thereto by means of a bolt. The cutting tool 19 is supported in the frame 15 so as to be movable up and down and vertically positionable to locate the edge 21*a* in cutting relationship with the sewable or sewed material 4. The transducer 23 is energized by a power supply 24 (FIG. 4) to impart high-frequency mechanical oscillations to the edge 21*a* via the amplifier horn holder 22 to cut the material which is moved along a desired cutting path.

The welding tool 20 in FIG. 6 may be used to weld pieces of thermoplastic resinous, sewable or sewed material(s) at its free end (lower) portion and is secured by means of a bolt to a horn holder 26 at one end thereof which has a smaller cross section. The other (upper) end of the horn holder 26 here again has an electromechanical transducer 27 secured thereto by means of a bolt. The welding tool 29 is supported in the frame 16 so as to be movable up and down and vertically positionable to locate the shoe 25*a* in a welding relationship with two or more overlapped pieces of the sewed or sewable material(s) 4. The transducer 27 is energized by a power supply 28 (FIG. 4) to impart high-frequency mechanical oscillations to the shoe 25*a* via the amplifier horn 26 to weld the overlapped pieces together which may be moved along a desired welding path. A desired mark may be marked as well in this manner.

What is claimed is:

1. A sewing method wherein a needle carrying at its forward end portion a thread and securely supported at its rear end portion by a support member is axially reciprocated therewith to repetitively penetrate into and through a sewable material moving relative to the axis of the needle to stitch the material, the method comprising imparting high-frequency mechanical oscillations to the reciprocating needle by activating an electromechanically activatable member directly and firmly secured to said support member and arranged so that said needle is longitudinally oscillated substantially in a direction of said axis at a high-frequency at least during the advance stroke of each cycle of the needle reciprocation, thereby facilitating the penetration of the needle into and through said sewable material.

2. A method wherein a needle carrying a non-metallic thread is axially reciprocated into and through a sewable material moving relative to the axis of the needle to stitch the material, the method comprising imparting high-frequency mechanical oscillations to the reciprocating needle at least predominantly in a direction which is substantially the same as the direction of the needle reciprocation at least during the advance stroke of each cycle of the needle reciprocation.

3. A method wherein a needle carrying a thread is axially reciprocated into and through a sewable material moving relative to the axis of the needle to stitch the material, the method comprising imparting high-frequency mechanical oscillations to the reciprocating needle substantially in a direction of the needle reciprocation, and intensifying said mechanical oscillations imparted to said reciprocating needle selectively during the advance stroke of each cycle of the needle reciprocation.

4. A method wherein a needle carrying a thread is axially reciprocated into and through sewable material moving relative to the axis of the needle to stitch the material, the method comprising imparting high-frequency mechanical oscillations to the reciprocating needle substantially in a direction of the needle reciprocation; sensing a load of said needle experienced from said material during each cycle of the needle reciprocation and; in response to a change in the sensed load, automatically increasing the amplitude of said mechanical oscillations.

5. The method defined in claim 4 wherein said amplitude of the mechanical oscillations is increased from a substantial nil value.

6. A sewing machine wherein a needle carrying at its one end portion a thread and securely supported at its other end portion by a support member is axially reciprocated into and through a sewable material moving relative to the axis of the needle to stitch the material, the machine including means for imparting high-frequency mechanical oscillations to the reciprocating needle, said means comprising a power supply, and a vibratile member firmly secured to said support member and oscillatory activatable by said power supply so as to longitudinally oscillate said needle substantially in a direction of said axis at a high-frequency at least during the advance stroke of each cycle of the needle reciprocation, thereby facilitating the penetration of the needle into and through said sewable material.

7. A machine wherein a needle carrying a non-metallic thread is axially reciprocated into and through a sewable material moving relative to the axis of the needle to stitch the material, the machine including means for imparting high-frequency mechanical oscillations to the reciprocating needle at least predominantly in a direction of the needle reciprocation; and means associated with said means and operable for imparting said mechanical oscillations to said reciprocating needle selectively during at least a time period in which said needle is advanced into and through said material in each cycle of the needle reciprocation.

8. A machine wherein a needle carrying a thread is axially reciprocated into and through a sewable material moving relative to the axis of the needle to stitch the material, the machine including means for imparting high-frequency mechanical oscillations to the reciprocating needle substantially in a direction of the needle reciprocation; and means associated with said means and operable for intensifying said mechanical oscillations imparted to said reciprocating needle selectively during at least a time period in which said needle is advanced into and through said material in each cycle of the needle reciprocation.

9. A machine wherein a needle carrying a thread is axially reciprocated into and through a sewable material moving relative to the axis of the needle to stitch the material, the machine including means for imparting high-frequency mechanical oscillations to the reciprocating needle substantially in a direction of the needle reciprocation, said means comprising an electromechanical transducer connected in an oscillation transmitting relationship with said needle and a power supply for energizing said electromechanical transducer to impart said mechanical oscillations to said reciprocating needle; sensing means responsive to a load experienced by said needle from said material during each cycle of the needle reciprocation; and control means responsive to an increase in said load for controlling said power supply to selectively produce or intensify said mechanical oscillations imparted to said needle selectively during at least a time period in which said needle is advanced into and through said material in each cycle of the needle reciprocation.

10. The machine defined in claim 6 wherein said support member comprises an amplifier horn member having one end of greater cross section attached to an electromechanical transducer constituting said vibratile member and the other end of a cross section adapted to support said rear end portion of said needle so as to project therefrom and to extend substantially coaxially with said horn member.

* * * * *